US010561915B1

(12) United States Patent
McGuiness et al.

(10) Patent No.: US 10,561,915 B1
(45) Date of Patent: Feb. 18, 2020

(54) PITCH TRAINING DEVICE

(71) Applicants: Michael Z. McGuiness, Potomac, MD (US); Connor Zukel McGuiness, Lewes, DE (US); Ronald Edwin Plummer, Haslet, TX (US)

(72) Inventors: Michael Z. McGuiness, Potomac, MD (US); Connor Zukel McGuiness, Lewes, DE (US); Ronald Edwin Plummer, Haslet, TX (US)

( * ) Notice: Subject to any disclaimer, the term of this patent is extended or adjusted under 35 U.S.C. 154(b) by 0 days.

(21) Appl. No.: 16/260,897

(22) Filed: Jan. 29, 2019

(51) Int. Cl.

| | |
|---|---|
| ***A63B 69/00*** | (2006.01) |
| ***A63B 37/12*** | (2006.01) |
| ***A63B 37/04*** | (2006.01) |
| ***A63B 43/00*** | (2006.01) |
| *A63B 69/36* | (2006.01) |

(52) U.S. Cl.
CPC ..... *A63B 69/0002* (2013.01); *A63B 37/04* (2013.01); *A63B 43/002* (2013.01); *A63B 69/00* (2013.01); *A63B 69/0079* (2013.01); *A63B 69/3688* (2013.01); *A63B 2069/0006* (2013.01)

(58) Field of Classification Search
CPC ... A63B 69/0002; A63B 37/04; A63B 43/002; A63B 2069/0006
USPC ..... 473/422, 451, 600, 613, 597; D21/707
See application file for complete search history.

(56) References Cited

U.S. PATENT DOCUMENTS

| | | | | | |
|---|---|---|---|---|---|
| 216,124 | A * | 6/1879 | Adams | A63B 69/0079 | 473/575 |
| 3,796,435 | A * | 3/1974 | Dale | A63B 69/3688 | 473/200 |
| D235,358 | S * | 6/1975 | Dufaud | D21/707 | |
| 4,128,238 | A * | 12/1978 | Newcomb | A63B 37/14 | 473/451 |
| 4,871,169 | A * | 10/1989 | Autorino | A63B 43/002 | 473/613 |
| 4,917,381 | A | 4/1990 | Spector | | |
| 4,955,620 | A * | 9/1990 | Reinke | A63B 65/00 | 473/596 |
| 5,472,187 | A * | 12/1995 | Kempf | A63B 65/10 | 473/451 |
| 5,984,813 | A * | 11/1999 | Cinnella | A63B 37/14 | 473/613 |
| 6,093,118 | A | 7/2000 | Simpson | | |
| 6,387,022 | B1 | 5/2002 | Smith | | |
| 7,247,106 | B1 * | 7/2007 | Brandt | A63B 43/00 | 473/422 |

(Continued)

OTHER PUBLICATIONS

Baseball spin max BX75-10; Rakuten, Inc.; Date Printed: Jan. 9, 2019; Date Posted: Unknown; <https://global.rakuten.com/en/store/drafuto1/item/bx75-10/https://global.rakuten.com/en/store/drafuto1/item/bx75-10/>.

(Continued)

*Primary Examiner* — Mitra Aryanpour
(74) *Attorney, Agent, or Firm* — Jerome Chang

(57) ABSTRACT

A pitch training device used to improve the throwing technique of balls used in sports. The device includes a core and a substantially disk-shaped body that provides immediate visual feedback as to whether the device was properly thrown. The core exhibits a density greater than the density of the body, thereby mimicking the moment of inertia of many sports balls. This, in turn, allows the user of the device to improve the training techniques used to increase spin efficiency of a ball while also helping train and improve other throwing techniques.

13 Claims, 4 Drawing Sheets

(56) References Cited

U.S. PATENT DOCUMENTS

| | | | | |
|---|---|---|---|---|
| 7,608,003 | B1 | 10/2009 | Fusco | |
| 8,197,363 | B1 | 6/2012 | Davignon | |
| 8,216,091 | B2 * | 7/2012 | Neal | A63B 43/002 473/422 |
| 8,439,774 | B2 | 5/2013 | Massey | |
| 8,708,843 | B1 * | 4/2014 | Sekac | A63B 37/12 473/422 |
| 9,132,329 | B2 | 9/2015 | Ebert | |
| 9,352,180 | B2 | 5/2016 | Pawlas | |
| 9,526,951 | B1 * | 12/2016 | Ganson | A63B 43/004 473/570 |
| 9,597,565 | B2 * | 3/2017 | Forutanpour | A45C 11/20 473/569 |
| 9,616,272 | B1 | 4/2017 | Bennett | |
| 9,788,527 | B1 | 10/2017 | Harrington | |
| 2005/0176532 | A1 | 8/2005 | Thorington | |
| 2006/0068952 | A1 | 3/2006 | Davignon, II | |
| 2007/0179021 | A1 | 8/2007 | Wang | |
| 2009/0137350 | A1 | 5/2009 | Lenig | |
| 2012/0322627 | A1 | 12/2012 | Emerson | |
| 2013/0337980 | A1 | 12/2013 | Himmelrick | |
| 2014/0094328 | A1 | 4/2014 | Shearer | |
| 2015/0182777 | A1 | 7/2015 | Rarity, IV | |
| 2016/0375317 | A1 | 12/2016 | Connelly | |
| 2018/0193696 | A1 | 7/2018 | Gwydir | |

OTHER PUBLICATIONS

Practice improvement for seam specification Sidecut ball spin checking junior training toy voluntary practice improvement tips toy pitching practice pitches balls fun random rotation; Rakuten, Inc.; Date Printed: Jan. 9, 2019; Date Posted: Unknown; <https://global.rakuten.com/en/store/s-sansin/item/bx74-11/?I-id=rgm_search_en_rvp_widget>.

Practice improvement for seam specification Sidecut ball spin checking training toy voluntary practice improvement tips toy pitching practice pitches balls fun random rotation; Rakuten, Inc.; Date Printed: Jan. 9, 2019; Date Posted: Unknown; <https://global.rakuten.com/en/store/s-sansin/item/bx74-12/?I-id=rgm_item_en_rvp_widget>.

Fun software 3, size rotation correction ball spin checker software 3 training toy voluntary practice improvement tips toy pitching practice throw ball practice; Rakuten, Inc.; Date Printed: Jan. 9, 2019; Date Posted: Unknown; <https://global.rakuten.com/en/store/s-sansin/item/bx76-49/?I-id=rgm_item_en_rvp_widget>.

And acquires basics of finger and wrist movements during throwing disk ball throwing disk ball training toy voluntary practice improvement tips toy pitching practice pitching rainy days at home; Rakuten, Inc.; Date Printed: Jan. 9, 2019; Date Posted: Unknown; <https://global.rakuten.com/en/store/s-sansin/item/bx74-57/>.

As Seen on TV Swerve Ball, Set of 3; Amazon.com, Inc.; Date Printed: Jan. 9, 2019; Date Posted: Unknown; <https://www.amazon.com/As-Seen-TV-Swerve-Ball/dp/B01C57GBK8>.

Rawlings Curve Ball Hit Training Set (Pack of 6); Amazon.com, Inc.; Date Printed: Jan. 9, 2019; Date Posted: Unknown; <https://www.amazon.com/Rawlings-Curve-Ball-Training-Pack/dp/B00GZ0Q90E>.

Baseball Spinright Spinner; Club K and Co., Inc.; Date Printed: Jan. 9, 2019; Date Posted: Unknown; <https://www.shopclubk.com/Baseball-Spinright-Spinner-BBS4.htm>.

Spin Right Softball Spinner; Club K and Co., Inc.; Date Printed: Jan. 9, 2019; Date Posted: Unknown; <https://www.shopclubk.com/Spin-Right-Softball-Spinner-804835000026.htm>.

The Buck 2 or 4 Seam Pitching Training Baseball; Epic Sports, Inc.; Date Printed: Jan. 9, 2019; Date Posted: Unknown; <https://baseball.epicsports.com/prod/72449/index.html>.

* cited by examiner

PITCH TRAINING DEVICE

CROSS REFERENCE TO RELATED APPLICATIONS

Not applicable.

BACKGROUND OF THE INVENTION

The present invention relates generally to training tools that improve throwing technique for sports that involve a thrown ball. Examples of such sports include baseball, softball, and cricket. More specifically, the present invention relates to those training tools that resemble a thick disk, biscuit or flattened ball, and provide immediate visual feedback upon being thrown.

A multitude of practice drills and devices have been developed in order to increase the command and accuracy of a thrown ball, the physics of which require precise throwing mechanics. As an example, in the sport of baseball, a baseball thrown by a pitcher observes many properties of classical mechanics found in translational motion or ballistic flight. Properties, such as the baseball's weight and rotation around its center of gravity, factor into the ball's flight path. That path, however, varies greatly from any theoretical ballistic flight calculation due to the baseball's raised stitching at its seams, which induce additional factors such as lift, drag, and Magnus forces that affect the ball's trajectory. Those forces, in turn, magnify the effects of the baseball's axis of rotation and angular speed, or spin, in determining the ball's trajectory, creating a variety of baseball pitches that exhibit varying curves and bends during flight. These pitches can broadly be identified as fastballs, curveballs, sinkers, and sliders, among others. For the aforementioned reasons, these baseball pitches, even those with the simplest throwing technique, can be difficult to master.

With the aim of refining the fundamental techniques for throwing a ball, several tools of the art exist, and as mentioned they resemble a thick disc, biscuit, or flattened ball. These tools generally exhibit a circular profile with two planar sides parallel to one another, and exhibit weights identical to those of a softball or baseball. These tools aim to provide visual feedback, indicating whether the tools were thrown with the proper technique, by not wobbling during its flight through the air. More specifically, the lack of wobble indicates that the tool's axis of rotation is stable and fixed in all three dimensions relative to a horizontal plane during the entire flight, thereby indicating a properly thrown tool. The technique used to properly throw such a tool is then transferred to the throwing of an actual ball. An example of such a training tool is disclosed in U.S. Pat. No. 5,472,187, entitled "Ball Pitch Training Device," issued Dec. 5, 1995, the disclosure of which is incorporated by reference herein. An additional example is disclosed in U.S. Pat. No. 8,708,843, entitled "Ball Training System for Pitchers," issued Apr. 29, 2014.

At present, training tools do not address a major factor that determines the flight path of a thrown ball. That factor is the ball's spin rate. For example, baseballs used in organized baseball leagues, such as Major League Baseball or the National Collegiate Athletic Association, are usually comprised of multiple layers. The spherical core of a baseball, known as a pill, is comprised of a high-density cork surrounded by two thin layers of rubber. This core has a diameter of roughly 10.47 mm. Wound around the pill is at least one layer of yarn. Thin layers of cotton, synthetic fabrics or elastomers may also be used in addition to the yarn. The ball is covered by two pieces of horsehide or cowhide tightly stitched together. The diameter of a baseball is 72.64 cm to 74.68 cm. As a result, a baseball has a core that is less dense than the outer layers of the ball. The lower density surrounding the pill creates a moment of inertia smaller than an identically shaped and identically weighted baseball that contains an evenly distributed density. For a given arm speed, this distribution of density within a baseball directly affects the angular speed around the ball's axis of rotation, which is a critical factor in baseball pitching. Therefore, a baseball's moment of inertia affects the technique of a thrower by forcing the thrower to consider and feel for the ball's moment of inertia in order to throw the ball with the thrower's intended trajectory.

At present, training tools that do not provide a substantially smooth surface where the fingers are placed can impede the successful training for many types of pitches. This is due to the fact that differences in finger placement that measure fractions of a millimeter in any direction can be the difference between a well thrown ball and a poorly thrown ball. Any raised surfaces located where the fingers grip the tool, other than those that mimic the stitching of an actual ball, reduced the effectiveness of the training tool.

At present, training tools exist that employ leather covers which scuff easily when the tools impact a hard surface. The resulting scuffs hinder the proper flight of the tool, rendering the tool less effective as a training aid.

In addition to pitching technique, a popular method for training pitchers in various sports employs balls that weight more or less than the regulation balls used during a game. This type of under- and over-weighted-ball training can increase the pitcher's arm conditioning and arm speed. At present, training tools weigh the same as the regulation balls they aim to mimic.

SUMMARY OF THE INVENTION

In an embodiment, the present disclosure for a pitch training device, in addition to providing immediate visual feedback for proper throwing technique, seeks to improve upon the prior art by possessing a moment of inertia similar to or equal to that of a regulation ball that has a core that is more dense than the remainder of the ball, by being constructed of thermoplastic materials that resist scuffing, by providing manufacturing efficiency when varying the device's overall weight, and by providing a seamless or flush transition between the two planar sides and the circular outer surface.

In an embodiment, the device is crafted from a core encapsulated within two half-bodies manufactured from thermoplastic material with a hardness greater than leather. Each half resembles a hemisphere with a spherical cap removed, thereby exposing a planar side instead of a curved surface as in a true hemisphere. The interior of each half contains a structural scaffolding with a central hemispherical void. The scaffolding allows the ball to exhibit durability and enduring usability after repeated throws while the voids defined by the scaffolding allow the density of each half to be less than that of the central spherical core. The halves also allow for a clean transition between the circular outer surface and planar side for accurate finger placement. Use of a thermoplastic material allows for the joining of the two halves via ultrasonic welding, which results in an unobtrusive and substantially flat seam on the surface of the device at the interface of the two halves, thereby allowing accurate finger placement. The design provides a simple way to vary the overall weight of the device, which makes it suitable to manufacture devices of varying weights for weighted-ball training.

In an embodiment, the device includes a design that allows the insertion of a smaller diameter core into the existing halves by utilizing smaller hemispherical halves that encapsulate the smaller core. Once encapsulated, the smaller diameter core snugly fits within the central hemispherical voids defined in the two larger halves.

In an embodiment, the device is crafted from a core surrounded by a solid, non-porous material less dense than the core.

In an embodiment, the core of the present invention is substantially spherical in order to provide moments of inertia that better mimic those of a regulation ball.

While a variety of pitch training devices have been made and used, it is believed that no one prior to the inventor has made or used an invention as described herein.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

DETAILED DESCRIPTION OF THE INVENTION

Figure 5:
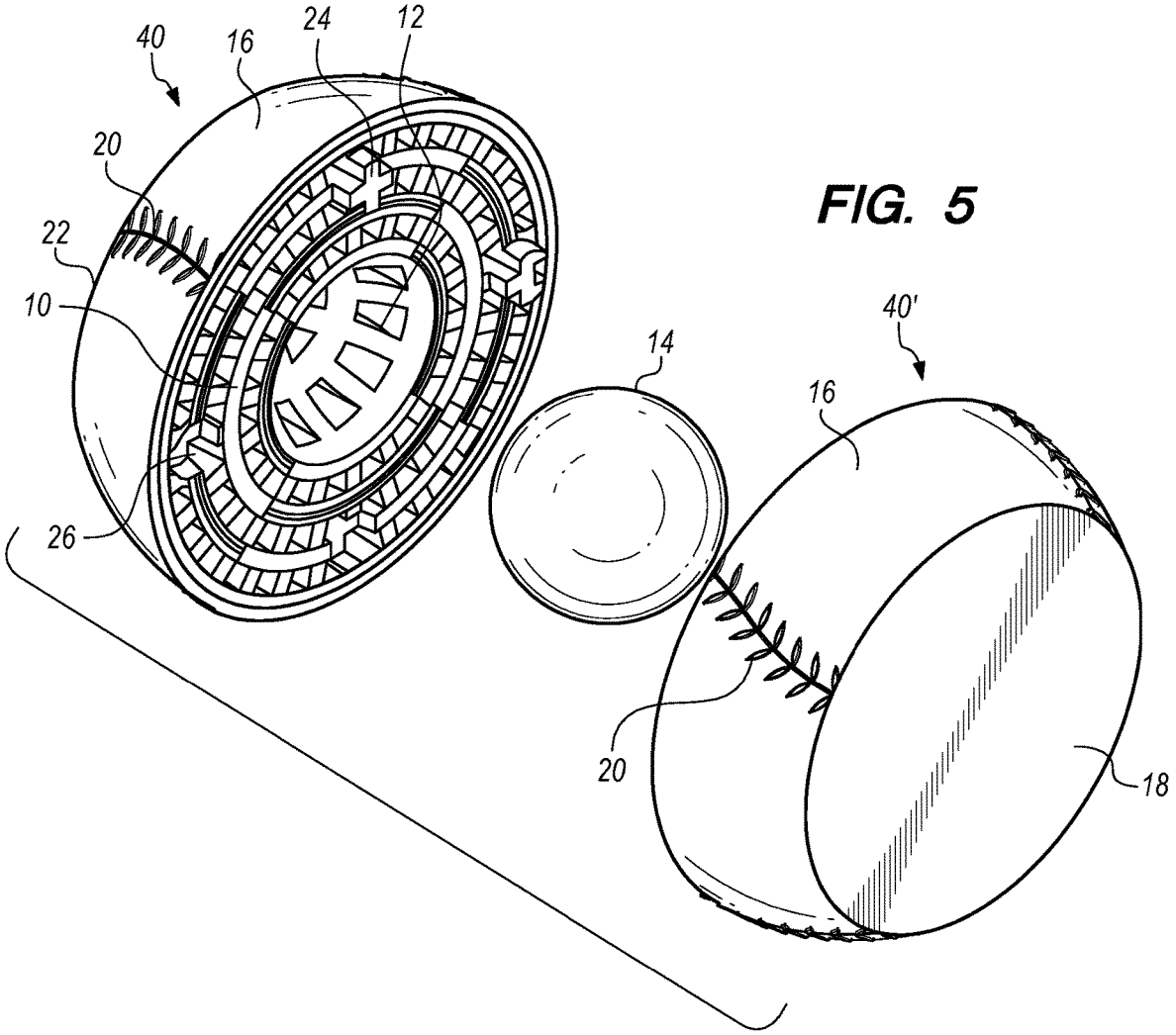
FIG. 5 shows a cross-sectional and exploded view of the device according to an embodiment.

FIG. 5 shows an exploded view of a preferred embodiment, which includes two half-bodies (40, 40) and a core (14). Each half-body (40, 40) may be manufactured from an injection-molded thermoplastic material that exhibits a hardness greater than the hardness of leather. Each half-body (40, 40) resembles a hemisphere with a spherical cap removed, creating a first planar surface (18) and a second planar surface (22), with each planar surface (18, 22) having substantially equal diameters. One half-body (40) defines a hemispherical void (12), and the second half-body (40) also defines a hemispherical void (not depicted). The hemispherical void (12, not depicted) of each half-body (40, 40) is oriented so that each void's circular opening is centered within its respective half-body (40, 40), and the plane of each circular opening is aligned to be substantially parallel with its respective planar surface (18, 22). Each hemispherical void (12, not depicted) is designed for the receipt and encapsulation of the core (14). One half-body (40) contains scaffolding (10) extending and connecting between the hemispherical void (12) and both the first planar surface (18) and the respective half of the circular outer surface (16). The scaffolding (10) of each half-body (40, 40) contributes one half of an enveloping scaffolded interior that surrounds the core (14) and is distributed throughout the volume of the device outside the core (14). The second half-body (40) also contains substantially identical scaffolding (not depicted). The scaffolding (10) may include a variety of designs, including, but not limited to, the form of straight ribs or studs extending radially from the hemispherical void (12) or as a type of three-dimensional lattice as shown in FIG. 5, with such lattice defining the edges of substantially rhomboidal openings. One half-body (40) presents a substantially planar interior side with at least one raised interlocking member (24) and defines at least one interlocking void (26). The second half-body (40') presents an identical number of interlocking members (not depicted) and interlocking voids (not depicted) so that each half-body (40, 40) may interlock with each other.

The core (14) is substantially solid and spherical, thereby mimicking the moments of inertia exhibited by a ball with a core denser than the density found in the remainder of the ball, such as in a baseball or softball. The core (14) is comprised of a material that is denser than the density of a half-body (40, 40'). The core (14) in its preferred embodiment, has a diameter of between 10 percent and 50 percent of the greatest diameter found within the device (38).

Figure 1:
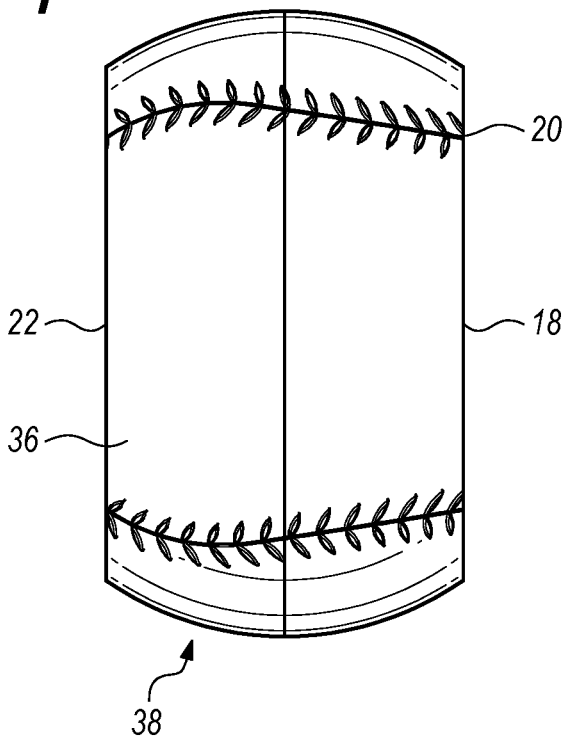
FIG. 1 shows a frontal view of the device, according to an embodiment.
Figure 2:
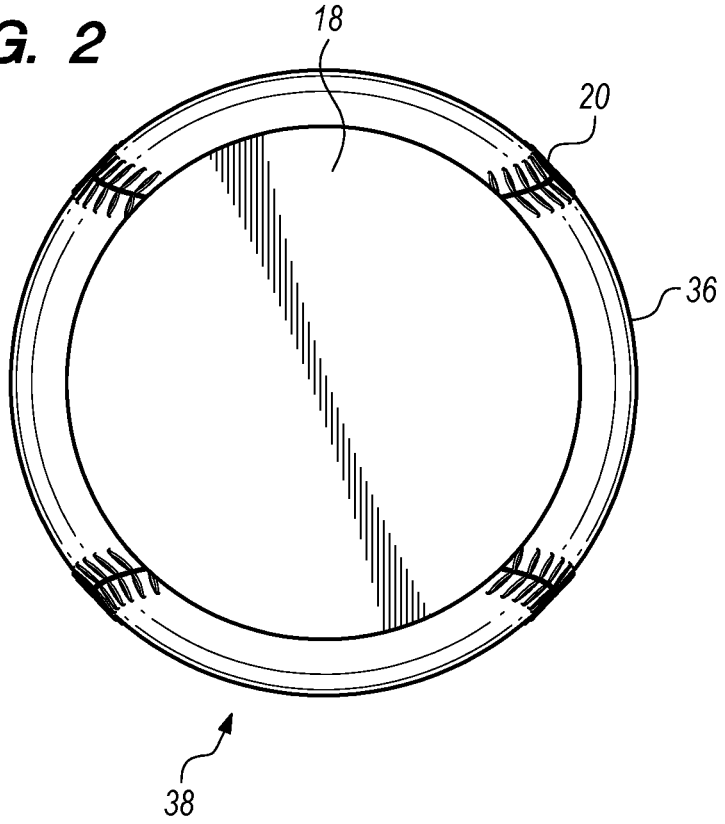
FIG. 2 shows a side view of the device, according to an embodiment.
Figure 3:
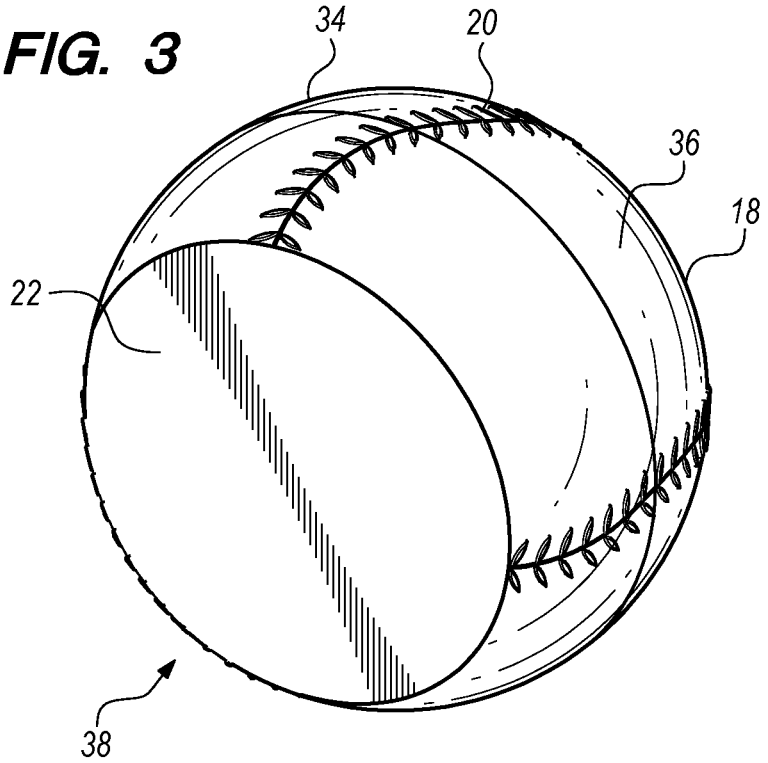
FIG. 3 shows a perspective view of the device with a one of its planar sides visible according to an embodiment.
Figure 4:
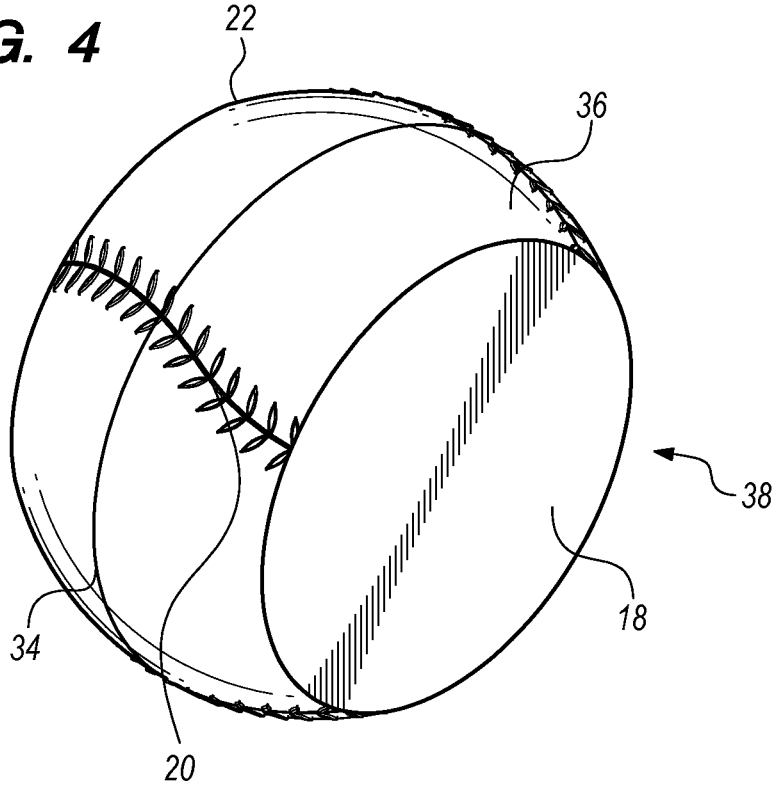
FIG. 4 shows a perspective view of the device with a planar side visible according to an embodiment, that planar side being the one opposite of that shown in FIG. 3.

In assembling the device, the raised interlocking members (24) and interlocking voids (26) of one half-body (40) insert into the raised interlocking members (not depicted) and interlocking voids (not depicted) of the other half-body (40), with the core (14) or encapsulated smaller core (32) situated snugly in the center. The half-bodies (40, 40) are joined together via an adhesive or ultrasonic welding, which creates a substantially smooth surface on the circular outer surface (36) that is defined as the surface lying between the first planar surface (18) and second planar surface (22). The circular outer surface (36) exhibits a curve that is substantially convex. A substantially smooth surface also exists at the interface (34) as shown FIGS. 3-4. The joined half-bodies (40, 40') create the substantially disk-shaped body of the device (38). The body of the device (38) exhibits a thickness defined by the distance between the first planar surface (18) and the second planar surface (22), with the thickness measuring between 30 mm and 76 mm in an embodiment. The first planar surface (18) and second planar surface (22) lie substantially parallel to each other. The device (38) contains no openings or undesirable raised elements that would inappropriately disturb its flight path.

In another embodiment, an enveloping interior surrounding the core is not scaffolded. The enveloping interior is evenly distributed throughout the volume of the device outside the core and may be comprised of thermoplastic material. The thermoplastic material may be injection-molded. In a further embodiment, the thermoplastic material may be comprised of thermoplastic foam.

For purposes of training baseball pitchers, the device (38) is configured to have an overall mass between 141 g and 454 g, with a circular outer surface (36) thickness of between 30 mm and 51 mm, a core (14) with a density between 2.72 g/cm cubed and 8.80 g/cm cubed. As an example, the core may be comprised of stainless steel or aluminum, copper, nickel, titanium, or an alloy thereof. The range of overall masses accommodate weighted-ball training. In another embodiment for training baseball pitchers, the device (38) is configured to have an overall mass between 113 g and 141 g. In another embodiment for training baseball pitchers, the device (38) is configured to have an overall mass between 149 g and 454 g. Embodiments for training baseball pitchers have planar surfaces (18, 22) that have a diameter of between 50 mm and 76 mm.

For purposes of training softball pitchers, the device (38) is developed to have an overall mass between 113 g and 454 g, with a circular outer surface (36) thickness between 30 mm and 76 mm, a core (14) with a density between 2.72 g/cm cubed and 8.80 g/cm cubed. As an example, the core may be comprised of stainless steel or aluminum, copper, nickel, titanium, or an alloy thereof. The range of overall masses accommodate weighted-ball training. In another embodiment for training softball pitchers, the device (38) is configured to have an overall mass between 113 g and 170 g. In another embodiment for training softball pitchers, the device (38) is configured to have an overall mass between 198 g and 454 g. Embodiments for training softball pitchers have planar surfaces (18, 22) that have a diameter of between 73 mm and 102 mm.

For purposes of training cricket bowlers, the device (38) is configured to have an overall mass between 141 g and 454 g, with a circular outer surface (36) thickness of between 30 mm and 51 mm, a core (14) with a density between 2.72 g/cm cubed and 8.80 g/cm cubed. As an example, the core may be comprised of stainless steel or aluminum, copper, nickel, titanium, or an alloy thereof. The range of overall masses accommodate weighted-ball training. In another embodiment for training cricket bowlers, the device (38) is configured to have an overall mass between 113 g and 156 g. In another embodiment for training cricket bowlers, the device (38) is configured to have an overall mass between 163 g and 454 g. Embodiments for training cricket bowlers have planar surfaces (18, 22) that have a diameter of between 68 mm and 73 mm.

Figure 6:
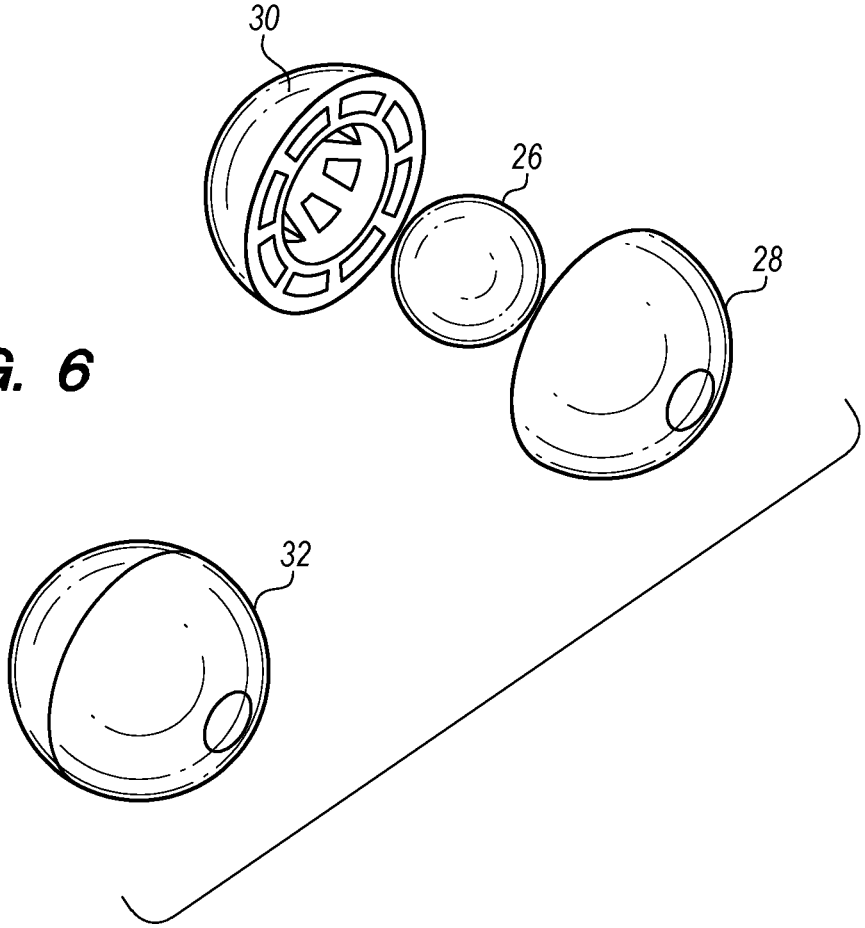
FIG. 6 shows a cross-sectional and exploded view of an encapsulated smaller core according to one embodiment, as well as an assembled encapsulated smaller core according to one embodiment.

As shown in FIG. 6, an embodiment of the device may accommodate a smaller core (26) by utilizing two half-capsules (28, 30), each substantially in the form of hemispheres that define two smaller hemispherical voids, with said smaller hemispherical voids oriented to encapsulate the smaller core (26). The two half-capsules (28, 30), once joined and encapsulating the smaller core (26), create an encapsulated smaller core (32) that fits snugly into the middle of the two half-bodies (40, 40'). This presents a simple and efficient way to vary the overall mass of the device during manufacture.

In another embodiment (not shown), the core (14) may take on a shape as needed in order to mimic the properties of the type of ball the thrower is practicing to throw.

FIGS. 1-5 show an embodiment that includes raised surface elements (20), that mimic the raised stitching of a baseball or softball and can be oriented in a variety of positions in order to facilitate the practicing of specific pitches that require different grips. The raised surface elements (20) may be marked in a color that contrasts from the color of the remainder of the device (38) in order to provide immediate and apparent visual feedback regarding the angular speed centered around the axis of rotation.

FIGS. 1-4 show the exterior of the device (38) from multiple perspectives. They are capable of representing multiple embodiments of the device. The perimeter of the circular outer surface (36) meets the circumference of the first and second planar surfaces (18, 22) cleanly, creating a flush and smooth corner, with no raised elements that would interfere with fingers that grip the device. This flush and smooth corner may be accomplished by manufacturing the entirety of each half-body (40, 40) as one injection-molded piece.

In another embodiment, shown in FIGS. 1-4, the interior (not depicted) of the device (38) contains an enveloping interior surrounding the core (14) and contains no scaffolding (10) apparent to the naked eye. The interior (not depicted) of the device (38) is a substantially solid material that is evenly distributed throughout the volume of the device outside the core (14). The solid material may be comprised of a material such as a thermoplastic material. The core (14) is comprised of a material that is denser than the density of the body.

The description herein of certain examples of the technology should not be used to limit its scope. Other examples, features, aspects, embodiments, and advantages of the technology will become apparent to those skilled in the art from the description herein, which is by way of illustration, one of the best modes contemplated for carrying out the technology. As will be realized, the technology described herein is capable of other different and obvious aspects, all without departing from the technology. Accordingly, the drawings and descriptions should be regarded as illustrative in nature and not restrictive.

It is further understood that any one or more of the teachings, expressions, embodiments, examples, etc. described herein may be combined with any one or more of the other teachings, expressions, embodiments, examples etc. that are described herein. The herein described teachings, expressions, embodiments, examples, etc. should therefore not be viewed in isolation relative to each other. Various suitable ways in which the teachings herein may be combined will be readily apparent to those of ordinary skill in the art in view of the teachings herein. Such modifications are intended to be included within the scope of the claims.

In the description herein, references to "one embodiment," "an embodiment," or "embodiments" mean that the feature or features being referred to are included in at least one embodiment of the technology. Separate references to "one embodiment," "an embodiment," or "embodiments" in the description herein do not necessarily refer to the same embodiment and are also not mutually exclusive unless so stated and/or except as will be readily apparent to those skilled in the art from the description. For example, a feature, structure, act, etc. described in one embodiment may also be included in other embodiments but is not necessarily included. Thus, the present technology can include a variety of combinations and/or integrations of the embodiments described herein.

The invention claimed is:

1. A device for training a person to throw a ball with proper technique, the device comprising:

a core, the core being substantially solid and spherical; and a body, the body being substantially disk-shaped, the body comprising:

a first planar surface and a second planar surface, the first planar surface and the second planar surface lying substantially parallel to each other, the first planar surface and the second planar surface having substantially equal diameters;

a circular outer surface lying between the first planar surface and second planar surface;

a thickness defined by the distance between the first planar surface and the second planar surface; and an enveloping scaffolded interior, the enveloping scaffolded interior surrounding the core and being distributed throughout the volume of the device outside the core;

wherein the core is comprised of a material that is denser than the density of the body.

2. The device of claim 1, wherein the device is comprised of two half-bodies, the two half-bodies encapsulating the core, each half-body comprising one half of the enveloping scaffolded interior, each half-body defining a hemispherical void for the receipt and encapsulation of the core.

3. The device of claim 1, wherein the device has a mass between 113 g and 141 g.

4. The device of claim 1, wherein the device has a mass between 149 g and 454 g.

5. The device of claim 1, wherein the core has a density between 2.72 g/cm cubed and 8.80 g/cm cubed.

6. The device of claim 1, wherein the thickness is between 30 mm and 55 mm.

7. The device of claim 1, wherein the core material is comprised of stainless steel or aluminum, copper, nickel, titanium, or an alloy thereof.

8. The device of claim 2, wherein the half-bodies are joined via ultrasonic welding.

9. The device of claim 2, wherein the half-bodies are created by injection-molding.

10. The device of claim 2, wherein each half-body defines at least one raised interlocking member and defines at least one interlocking void, allowing the insertion of the raised interlocking member of one half-body into the interlocking void of the other half-body.

11. The device of claim 2, wherein the half-bodies are comprised of thermoplastic material.

12. The device of claim 2, wherein the device has an enveloping scaffolded interior substantially in the form of a three-dimensional lattice.

13. The device of claim 2, further comprising two half-capsules encapsulating a core to create an encapsulated core that is encapsulated by the two half-bodies.

* * * * *